US008578867B2

(12) United States Patent
Gustavsson

(10) Patent No.: US 8,578,867 B2
(45) Date of Patent: Nov. 12, 2013

(54) SECURITY CONTAINER WITH TWO LOCKS

(75) Inventor: Jack Gustavsson, Katrineholm (SE)

(73) Assignee: Cesium AB, Katrineholm (SE)

( * ) Notice: Subject to any disclaimer, the term of this patent is extended or adjusted under 35 U.S.C. 154(b) by 2103 days.

(21) Appl. No.: 10/585,980

(22) PCT Filed: Jan. 24, 2005

(86) PCT No.: PCT/SE2005/000074

§ 371 (c)(1),
(2), (4) Date: Aug. 15, 2006

(87) PCT Pub. No.: WO2005/069747

PCT Pub. Date: Aug. 4, 2005

(65) Prior Publication Data

US 2008/0222970 A1 Sep. 18, 2008

(30) Foreign Application Priority Data

Jan. 22, 2004 (SE) ..... 0400144

(51) Int. Cl.
*E05G 1/024* (2006.01)

(52) U.S. Cl.
USPC ..... 109/84; 109/76; 109/80

(58) Field of Classification Search
USPC ..... 70/74, 76, 78, 80, 82, 84; 109/74, 76, 109/78, 80, 82, 84
See application file for complete search history.

(56) References Cited

U.S. PATENT DOCUMENTS

| | | | | | |
|---|---|---|---|---|---|
| 1,759,723 | A | * | 5/1930 | Weld | 109/80 |
| 2,492,422 | A | * | 12/1949 | Govan | 109/84 |
| 4,158,338 | A | * | 6/1979 | Dippold et al. | 109/79 |
| 4,438,606 | A | | 3/1984 | Chardon et al. | |
| 4,455,801 | A | * | 6/1984 | Merritt | 109/84 |
| 4,704,880 | A | | 11/1987 | Schlindwein | |
| 4,721,227 | A | * | 1/1988 | Hughes et al. | 109/78 |
| 5,069,358 | A | * | 12/1991 | Avery, Jr. | 109/84 |
| 5,152,231 | A | * | 10/1992 | Preston et al. | 109/80 |
| 5,265,385 | A | | 11/1993 | Smith et al. | |
| 5,377,514 | A | * | 1/1995 | Robbins et al. | 109/80 |
| 5,490,468 | A | * | 2/1996 | Polensky | 109/80 |
| 5,813,174 | A | * | 9/1998 | Waller | 109/78 |
| 6,273,007 | B1 | * | 8/2001 | Alizade | 109/84 |
| 6,386,122 | B2 | * | 5/2002 | Alizade | 109/78 |
| 6,736,473 | B2 | * | 5/2004 | Cleveland et al. | 109/80 |
| 2002/0166483 | A1 | | 11/2002 | Alizade | |

FOREIGN PATENT DOCUMENTS

| | | |
|---|---|---|
| FR | 2689172 | 10/1993 |
| GB | 2 372 066 | 8/2002 |

* cited by examiner

*Primary Examiner* — Christopher Boswell
(74) *Attorney, Agent, or Firm* — Young & Thompson

(57) ABSTRACT

A security container includes at least one basic module, at least one floor element, at least one ceiling element, side wall elements, and one end piece. The side wall element and end piece are mounted between the floor element and the ceiling element at the basic module, and the basic module is attached to one door section equipped with a lock device in connection to an end piece and/or side wall elements.

10 Claims, 4 Drawing Sheets

Figure 2:
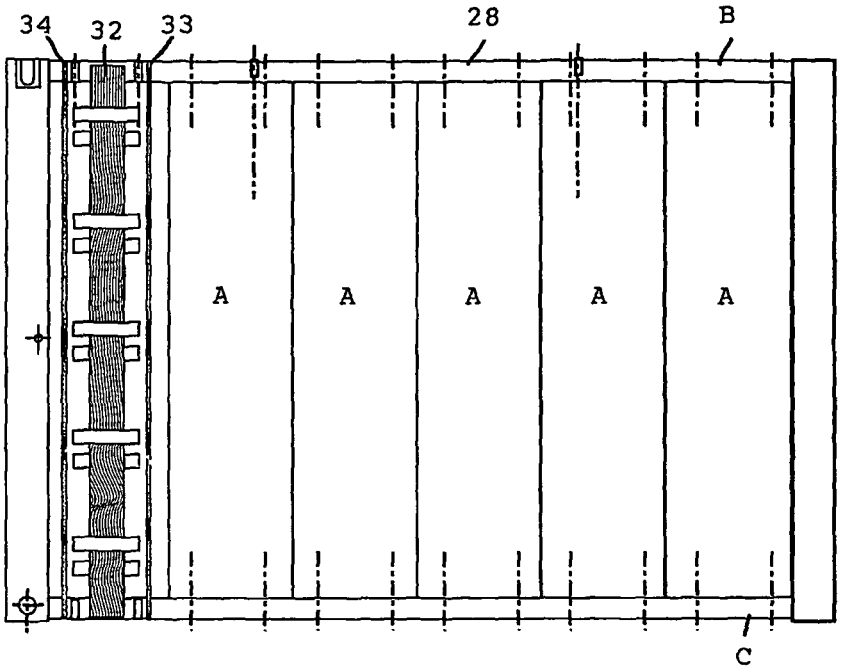

Fig. 1a
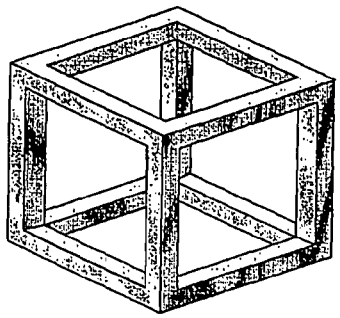
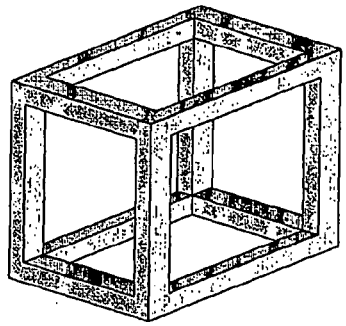
Fig. 1b
Fig. 1c
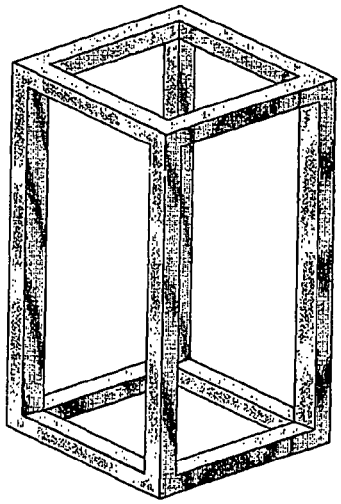
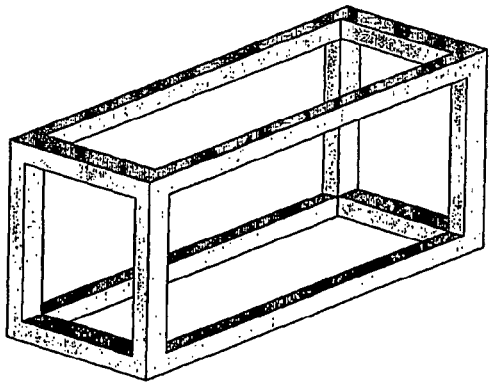
Fig. 1d

SECURITY CONTAINER WITH TWO LOCKS

BACKGROUND OF THE INVENTION

1 . Field of the invention

The present invention relates to a method using a module kit to construct a safety container of an arbitrary shape, a module set used to carry out said method and a safety container comprising of one or several of said modules.

2 . Description of the Related Art

To keep the excess at burglary reasonably low the insurance company call for better and better documented safe storing of property. A safe storing is also in the interest of the leasing and finance companies as they are the owners of the property during the lease or property purchase by installments. Also an increase of fraud when reporting loss of property is connected to the low risk of being detected due to scanty police resources.

For a company it is important that a planned daily activity can be carried out without interruption, which will easily be the case if the company is the victim of burglary. Within certain enterprises, as in the building trade and in other kind of contract work this is of particular importance as other sub contractors often are depended of that certain tasks are performed by others within stipulated time limits to make it possible for them to execute their own work at the right time. In addition to this comes that the building site is a temporary place of work where tools and material have to be safely stored. Often tools and machines at a building site are of the kind that can be used for criminal operations. Also by this reason it is important that they are stored safely.

In former days the term professional thieves meant a group of dishonest people which with a long experience and a high skill could break into locked spaces and unlawfully take others property. Today there are internationally working crime syndicates and terror organisations having access to advanced equipment, as plasma lances and diamond cutting tools. These groups are kept informed about where goods that are especially liable to be stolen are stored and in which way this goods are protected. Unfortunately it has shown that a manned guard for the property have a deterrent effect to an ever increasing extent. Today one can expect that such a manned guard without hesitation is disarmed or liquidated to get a hold of the property.

In the struggle for honesty and to provide guard against sabotage to the everyday work more protection being hard to break will be called for, which will become expensive to the society. Nevertheless this increase in prices must be compared to the costs involved in burglaries and swindles. The companies, not to say the whole society, will probably find it profitable to invest in burglary protection which is safer and harder to break.

It is not realistic to have a burglary protection being 100% safe. Thus, it is just plausible to make it so much harder for an unwarranted access to a storing place for property, that the effort and the tools needed to perform this access shall be so repellent and so advanced, respectively, that very few persons can put this into practice and perform a theft within a reasonable time. If the exposure of occasions for theft are decreased by safer storing of the property the costs of the society for these thefts and frauds will also decrease and, at the same time, the prerequisite of a "profitable" criminality will deteriorate.

SUMMARY OF THE INVENTION

The main object of the present invention is to, at a reasonable cost, obtain a method using a module kit to construct a safety container of an arbitrary shape, which purpose is to obstruct an unwarranted access also with advanced tool equipment.

The containers here mentioned are such which can be handled and mounted with a moderate effort. Therefore; each part is proportionately easy to handle, if necessary with a mobile lifting equipment. On the other hand the container is built by the mounted parts of the module kit, besides of being hard to break into, in practice impossible to move.

The storing container according to the present invention can be manufactured in different security classes and sizes, and will in the following be described both as a somewhat smaller and simpler container for storing of e.g. constructing necessities and tools, and as a bigger, heavier container for storing e.g. more bulky tool equipment, weapons and/or ammunition.

Thus with the invention a module system in the form of a construction kit is obtained where both the size of each module forming part of the finished container and the security level of the same can be chosen according to requirements.

An other object of the invention is to obtain a module system where the parts can be constructed of different materials, and which according to their chosen positions in the part will make this part extremely hard to break with common used burglar tools and methods.

Yet another object with the present invention is to obtain an enforced and protected lock device for said container, which device is suited both to lock a door of the container, but which device also can be used to direct and mutually lock the other parts of the module kit.

Further another object of the invention is to obtain a protected lock device for said storing container which is very hard to break also from the inside of said container.

The above stated objects of the invention is obtained by a module kit, a container and by a lock device and the concrete having been given the characterizing clauses stated in the claims.

The method using a primary module of different shape and security class, where each part of the kit is so dimensioned with regard to extension and weight that it will be manually manageable by using of a mobile lifting equipment, it will, with a reasonable input of personal and machinery be possible to build safe storing containers for machines, equipment and material at a temporary worlding site. When, at the same time, the mounted container, which can comprise one, two, three or more basic modules, preferably as a solid open, in one piece moulded concrete construction with a squared or rectangular cross-section, after a mounting thereon of sections for floor, ceiling and walls, and when the container being closed and locked by its door section, does not show any outwards accessible narrow openings or points of attack for tools, e.g. corner chisel or the like, at the same time as the weight of the container does not allow for a simple removal of the complete container, the container will provide a very good protection for property being stored therein.

By having each part of the container over a certain weight equipped with bails and/or hooks for an extern attachment of lifting means, these bails and/or hooks having an intentionally limited strength and placing, the advantage is obtained that these bails and/or hooks can not be used to lift a finished mounted container, as this will be too heavy regardless if several hooks should be used in a lifting action. It is also possible to have such lifting means being insert able into the container when not used, thus not accessible from the outside.

By having parts in the door section, in a closed position of the same, protruding into and/or behind adjacent side portions, and in a locked position, having looking means protruding into the floor element and into the top element, it will be very difficult to remove a door section, even though its butt hinge would be placed on and being able to manipulate from the outside of the container.

By having the different parts/elements of the container filled with concrete, the advantage, besides of higher weight of each part/element, is that special tool equipment must be used to break trough the concrete. To further make it more difficult to saw through the concrete, metal casings at the inside and at the outside of the parts, and reinforcing wooden scantlings and/or pellets of wood/rubber pieces in the concrete are used. By this a concrete saw will tend to pinch and stuck in an effort to saw through. The presence of scantlings, wooden pellets and mix of rubber in the concrete in all parts will also make it extremely hard to cut through the concrete using a plasma lance. The weakening of the concrete by mixing pellets and rubber pieces into it is not critical as the necessary physical properties is obtained by the combination and by the placement of the material chosen.

BRIEF DECRIPTION OF THE DRAWING FIGURES

Figure 3:
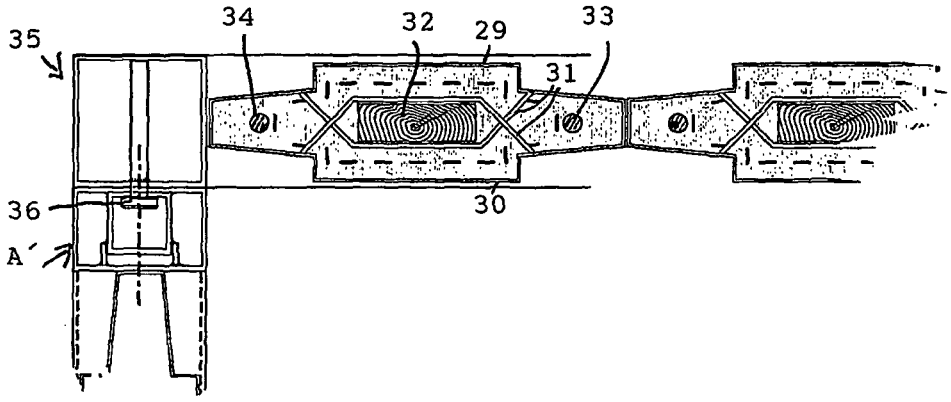
Figure 4:
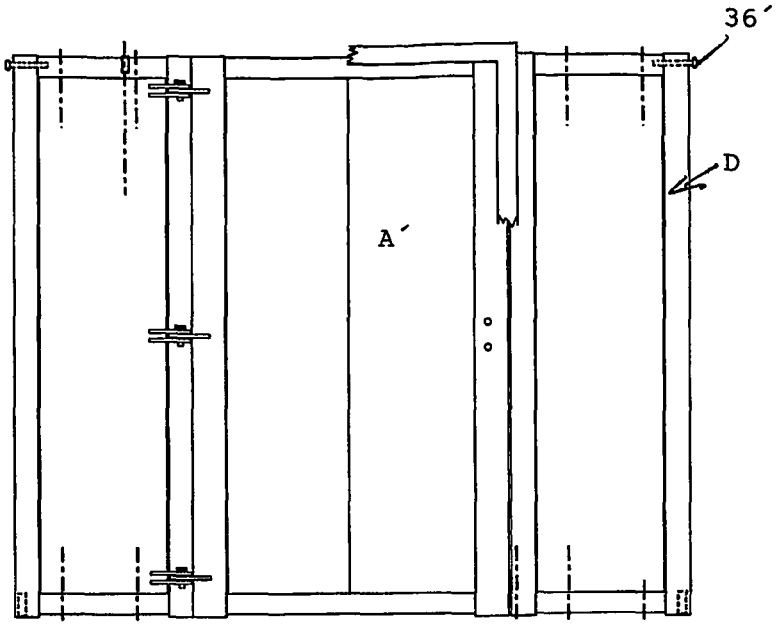
Figure 5:
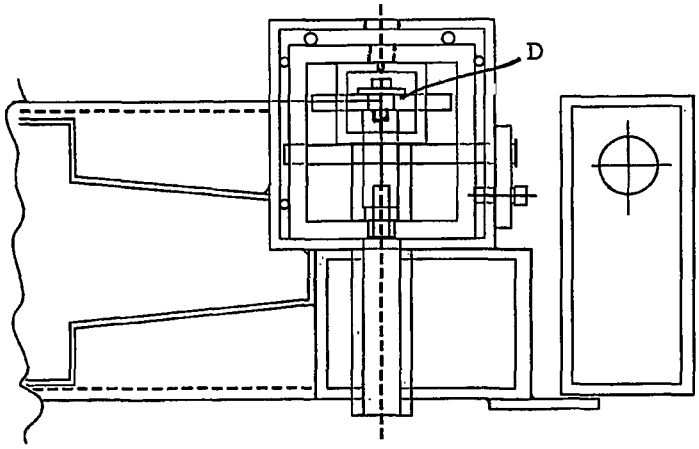
Figure 6:
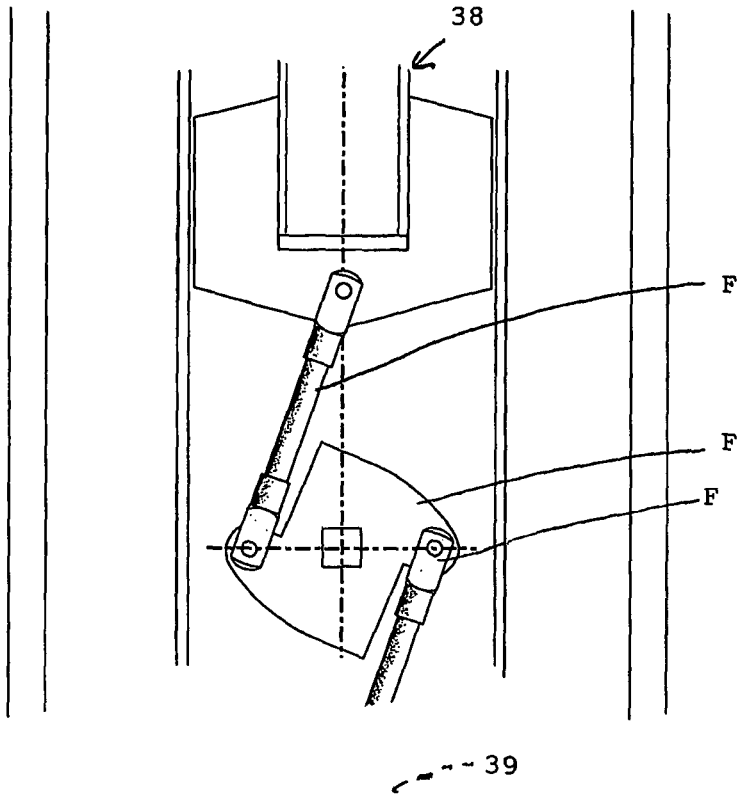
Figure 7:
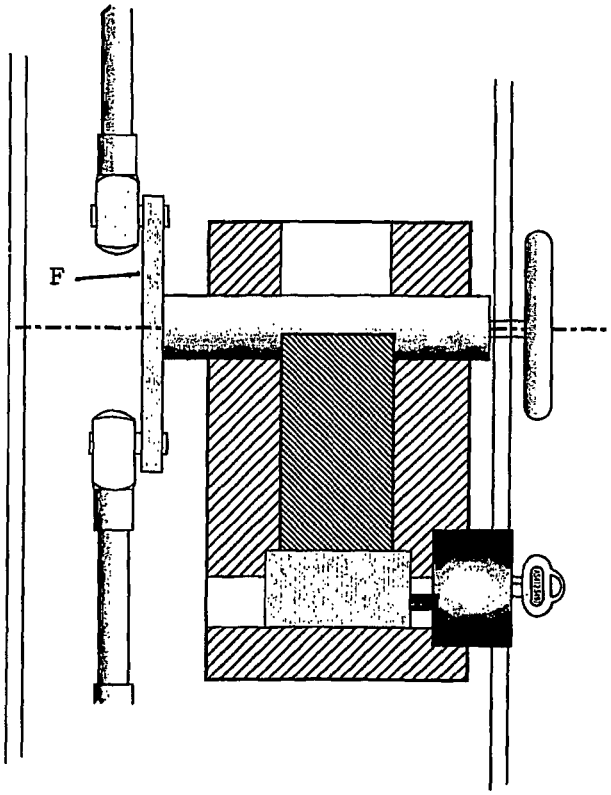

The invention will now be described in connection to a couple of shown embodiments, where;

FIGS. 1*a*-1*d* show differently shaped basic modules forming part of the module kit for storing containers, FIG. 2 is a side view, with a partly broken away portion of a side wall forming part of the module kit for a mountable, burglar proof and lockable storing container with heavier and more robust parts in the module kit, FIG. 3 shows the side wall according to FIG. 2 in a sectional view from above, FIG. 4 shows a front view of a door section for the storing container, FIG. 5 shows a sectional view of the countersunk lock device being used in the storing container according to FIG. 4, FIGS. 6 and 7 shows a lock plunger actuated mechanism for a storing container according to FIG. 4.

DETAILED DESCRIPTION OF THE INVENTION

FIGS. 1*a*-1*d* show differently shaped basic modules forming part of the module kits. In FIG. 1*a* the basic module has the outer shape of a cube. It is just the edge and corner portions being materialized by being moulded in concrete with a necessary enforcement and thickness for the security class being obtained. To this basic module is later attached roof elements, wall elements, ceiling elements and door module in a way to be described in connection to other embodiments.

In FIG. 1*b* the basic module has a rectangular shape and are twice as long as wide, while the basic module according to FIG. 1*c* is twice as high as wide and in FIG. 1*d* is the basic module three times as long as high and wide. It shall here be carefully noticed that these different basic modules can be combined according to the existing need. Thus they can be used to create a necessary floor space by arranging several modules side-by-side. Hereby the modules are preferably mutually attached on the inside, i.e. the attachment of the modules is hidden, preferably by arrangements of through bolts.

In FIG. 2 a side view is shown with a partly out broken party of a wall module 28 forming part of the module set for an alternative embodiment of a mountable storing container, but here in a completely closed, heavier and more robust shape and in a higher security class. From FIG. 2 is disclosed that the wall module 28 has several segments A and in FIG. 3 is shown profiled outer and inner wall element 29, 30 forming part of the segments and resting against an upper and a lower profile beam B, C, wherein distance means 31 are arranged between the wall elements 29, 30 and between which scantlings 32 are placed and extend along the whole height of the module. The segments A are mutually welded and the width of each segment is chosen such that wall modules of various standardized length is obtained by choosing a suitably number of segment A. Besides of the scantlings 32 there are also arranged metal bars 33, 34, preferably reinforcing irons which also extend along the whole length of the wall module 28. By these metal bars it will be very difficult to use e.g. a rotating cutting machine or any other rotating tool to break through a wall element. From FIGS. 2 and 3 is disclosed that each segment's A profile with inserted scantling 32, and with the metal bars 33, 34 arranged in the upper and in the lower profile beam B and C. From FIG. 3 is also disclosed how den end portions of the wall module 28 are shaped to allow a secure and not able to manipulate corner arrangement 35 (FIG. 3) of a mounted container. For this purpose is one from the side of the corner portion of the container protruding mounting knob 36 arranged and intended to insert in a conveniently suited notch in the corner portion of an adjacent wall module A'. By this corner arrangement 35 the connecting elements between the wall modules will be hidden for an outer influence. It is just through excess to the storing containers by entrance through a correctly opened door as it will be possible to demount the wall modules. Said wall modules are bolted onto the lower modules of concrete and on the wall modules roof modules of concrete are placed. The roof modules do cover the door module and the wall modules completely and are bolted from the inside.

Entrance to the storing container will be through the door, which is shown in a front view in FIG. 4. Also at this embodiment the door framing and the side edge of the door have a projection and a recess, respectively allowing the side edge of the door to be obstruct locked in the door frame in a closed position of the door. At an embodiment of the invention there are similar arrangements which from the inside cover the slit between the door and the door framing. In a closed position in FIG. 4 there is also shown an upper protruding mounting knob 36' in connection to a wall module D adjoining the door opening of the storing container. Also the door consists of segment A' —in this case two segments. Moreover the door module is constructed in the same way as the wall module such has been mentioned above, i.e. it is filled with concrete and takes up a scantling and metal bars or reinforcing irons. The doors locks around the side wall elements and robust lock plungers are activated and protrude into recesses in the floor module elements and in the ceiling module elements.

The lock for a storing container according to the present invention is shown in FIG. 5 being a sectional view through a counter sunk lock device D connected to the link mechanism F (see also FIGS. 6 and 7) which in turn exert an influence on two robust lock plungers 38, 39, where one of them 38 protrudes into a recess in the bottom module of the container, and the other 39 protrudes into a recess in the ceiling module of the container. Also the lock and key mechanism used here at this second embodiment can be of the kind having a lock house of steel and in which eccentric means interacts upon a retaining plunger also arranged in the lock house to move this plunger into or out of a recess in connection to a handle mechanism to lock or unlock this mechanism in connection to a locking or unlocking of the lock plungers into or out of the recesses in the floor element and the ceiling element.

The link mechanism F can also have a connected and horizontally directed lock or plunger means protruding into one door half or into one wall module. The link mechanism can also be shaped as a ratchet mechanism, wherein gear racks are arranged to the connected vertical and if necessary horizontally directed plunger means and lock means.

At an extra high security for the storing container several different actors may have a task to unlock one lock each, i.e. it comes to the participation of several actors (also outsiders—e.g. a security company) assistance to unlock a security container according to the invention. Preferably this can be done in that a mortise lock with its own key will cover the entrance to a countersunk head lock, which in turn has its own key with an extended shaft. To further increase the security and make an unwarranted access to the head lock more difficult a foldable mechanical cover or lid may be folded and locked in a covering position to the lock device.

The invention is not restricted to the above described embodiments, but modifications can be done within the scoop of the following claims.

The invention claimed is:

1. A security container, comprising:

at least one basic module;

at least one floor element;

at least one ceiling element;

side wall elements; and one end piece, the side wall elements and the end piece being mounted between the floor element and the ceiling element at the basic module, the basic module being attached to one door section equipped with a lock device in connection to at least one of the end piece and the side wall elements, wherein the door section, in its closed position, has parts protruding into or behind, or into and behind, adjacent side wall elements, and, in a locked position, has locking means protruding into the floor element and into the ceiling element, the wall sections have outer and inner casings of metal, an intermediate space is partially filled with concrete, the container having metal casings between which a plurality of scantlings are arranged, and at least two independent of each other locking devices are arranged in connection to a door section in which at least one primary locking device will protect against admission to a secondary head locking device.

2. The security container according to claim 1, wherein one or several basic modules of a same or of different shapes and with a certain maximal weight, are equipped with at least one of bails and hooks for an external application of lifting means, said at least one of bails and hooks in their attachment into the basic module have an intentionally limited strength.

3. The security container according to claim 1, wherein the concrete has ballast in the shape of rubber pieces.

4. The security container according to claim 1, wherein the primary locking device has a shape of a mortise lock with a bayonet catch hiding another primary locking device or the secondary head locking device.

5. The security container according to claim 1, wherein the security container comprises a plurality of basic modules

6. A security container, comprising:

at least one basic module;

at least one floor element;

at least one ceiling element;

side wall elements; and one end piece, the side wall elements and the end piece being mounted between the floor element and the ceiling element at the basic module, the basic module being attached to one door section equipped with a lock device in connection to at least one of the end piece and the side wall elements, wherein the door section, in its closed position, has parts protruding into or behind, or into and behind, adjacent side wall elements, and, in a locked position, has a locking element protruding into the floor element and into the ceiling element, the wall sections have outer and inner casings of metal, an intermediate space is partially filled with concrete, the container having metal casings between which a plurality of scantlings are arranged, and at least two independent of each other locking devices are arranged in connection to a door section in which at least one primary locking device will protect against admission to a secondary head locking device.

7. The security container according to claim 6, wherein one or several basic modules of a same or of different shapes and with a certain maximal weight, are equipped with at least one of bails and hooks for an external application of lifting means, said at least one of bails and hooks in their attachment into the basic module have an intentionally limited strength.

8. The security container according to claim 6, wherein the concrete has ballast in the shape of rubber pieces.

9. The security container according to claim 6, wherein the primary locking device has a shape of a mortise lock with a bayonet catch hiding another primary locking device or the secondary head locking device.

10. The security container according to claim 6, wherein the security container comprises a plurality of basic modules.

* * * * *

UNITED STATES PATENT AND TRADEMARK OFFICE

CERTIFICATE OF CORRECTION

PATENT NO. : 8,578,867 B2
APPLICATION NO. : 10/585980
DATED : November 12, 2013
INVENTOR(S) : Jack Gustavsson It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 2111 days.

Signed and Sealed this
Twenty-second Day of September, 2015

Michelle K. Lee

Michelle K. Lee
*Director of the United States Patent and Trademark Office*